United States Patent [19]

Blasnik et al.

[11] 4,074,838

[45] Feb. 21, 1978

[54] GARMENT HANGER CONSTRUCTION

[75] Inventors: William Blasnik, Demarest, N.J.; David Halpert, Melville, N.Y.

[73] Assignee: Lerner Manufacturing, Inc., Melville, N.Y.

[21] Appl. No.: 777,238

[22] Filed: Mar. 11, 1977

[51] Int. Cl.[2] ..... A47J 51/098

[52] U.S. Cl. ..... 223/85

[58] Field of Search ..... 223/85, 88, 92, 91; 211/113, 115; 248/339, 340

[56] References Cited

U.S. PATENT DOCUMENTS

| | | | |
|---|---|---|---|
| 2,460,438 | 2/1949 | Treiman | 223/92 |
| 3,069,054 | 12/1962 | Treiman | 223/92 |
| 3,319,850 | 5/1967 | Rosen | 223/92 |
| 3,963,154 | 6/1976 | Schwartz | 223/88 X |

FOREIGN PATENT DOCUMENTS

| | | | |
|---|---|---|---|
| 739,206 | 10/1955 | United Kingdom | 223/94 |

*Primary Examiner*—George H. Krizmanich
*Attorney, Agent, or Firm*—Blum, Moscovitz, Friedman & Kaplan

[57] ABSTRACT

A garment hanger construction wherein a hook is adapted to be releasably secured to a hanger body in a first locked position and a second swivel position, is provided. The hook includes an elongated shaft having at least first and second projections. The hanger body includes a bearing sleeve for receiving the elongated shaft, the bearing sleeve having a projection receiving slot and a projection receiving groove. The hook is coordinately axially displaceable between a first locked position wherein the first projection is disposed in the slot in the bearing sleeve to thereby prevent the hook from rotating and a second swivel position wherein the second projection is disposed in the groove to permit the hook to freely swivel with respect to the hanger body.

12 Claims, 11 Drawing Figures

FIG.1
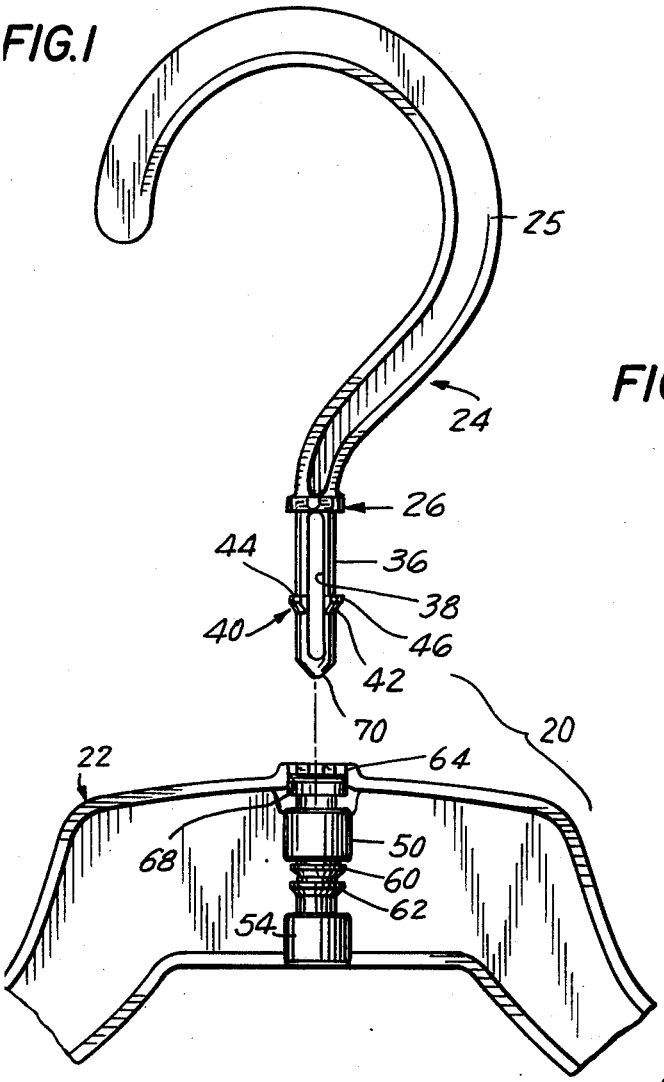
FIG.3
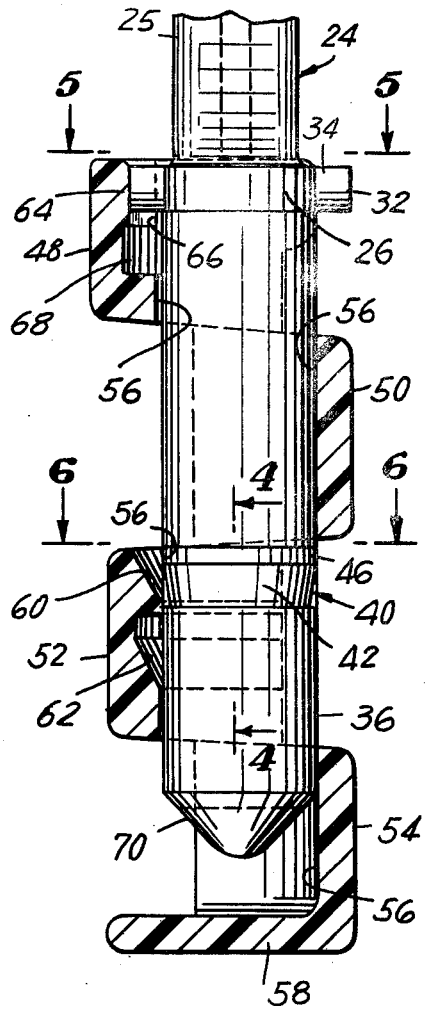
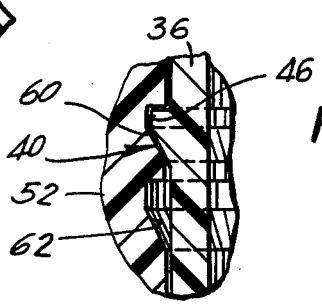
FIG.4
FIG.2
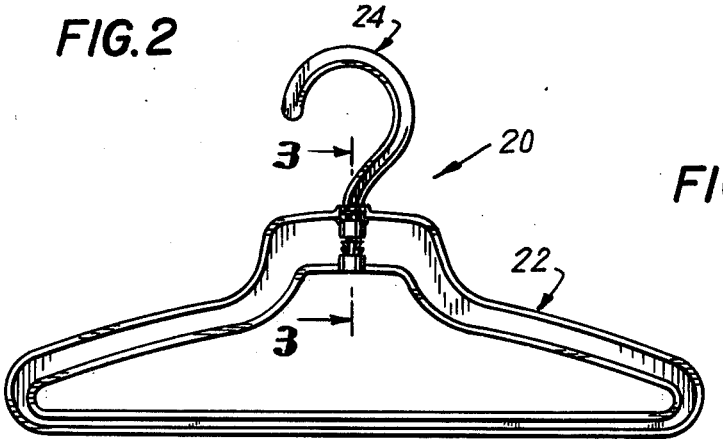
FIG.5
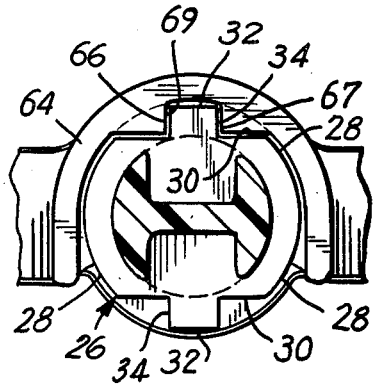

GARMENT HANGER CONSTRUCTION

BACKGROUND OF THE INVENTION

This invention is directed to a garment hanger construction, and in particular, to a garment hanger construction having a hook adapted to be releasably secured to a hanger body and be coordinately displaceable between a first locked position and a second swivel position.

Swivel hook garment hanger garment constructions, wherein a hook is releasably and rotatably secured to a garment hanger body are well known in the art. An example of one such garment hanger construction, wherein the manner in which the hook is releasably secured to the hanger body, results in improved structural rigidity being particularly imparted to the hanger construction shown and described in U.S. Pat. No. 3,963,154, which patent is assigned to the same Assignee as the instant invention.

It is noted however that a particular disadvantage, that inures to swivel hook garment hanger constructions is the inability to avoid unwanted swiveling when a garment is being carried on the hanger body. For example, when garments are placed on a rack for shipping and/or storage, swiveling of the hanger body with respect to the hook can often be troublesome and, at the least, render storage and handling of the garments more difficult. Heretofore, garments have been shipped from the manufacturer on one-piece non-rotatable garment hangers and are transferred to a swivel hook garment hanger at the retailing outlet. Accordingly, a garment hanger construction wherein a hook is releasably secured to a hanger body, so that the hook is coordinately displaceable between a first locked position and a second swivel position to thereby avoid the necessity of changing hangers, is desired.

SUMMARY OF THE INVENTION

Generally speaking, in accordance with the invention, a hanger construction is provided wherein a hook is adapted to be releasably secured to a hanger body and coordinately displaceable between a first locked position and a second swivel position. The hook includes a longitudinal shaft having first and second axially displaced lateral projections. The hanger body includes a bearing sleeve that defines a locking slot for receiving the first projection on the elongated shaft and preventing the hook from swiveling with respect to the hanger body, and a groove for receiving the second projection and permitting the hook to freely swivel with respect to the hanger body.

Accordingly, it is an object of this invention to provide an improved swivel hook garment hanger construction wherein a hook is releasably and rotatably secured to a hanger body.

Another object of this invention is to provide an improved garment hanger construction including a hook adapted to be displaced to locked position for preventing rotation of the hook with respect to the hanger body.

A further object of this invention is to provide an improved garment hanger construction wherein a hook is coordinately displaceable between a first locked position and a second swivel position.

Still another object of this invention is to provide an improved swivel hook garment hanger construction in which the hook member is releasably mounted to the hanger body.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a partial exploded elevational view of a hanger construction including a hanger body and hook member constructed in accordance with a preferred embodiment of the instant invention;

FIG. 2 is an elevational view of the assembled garment hanger construction illustrated in FIG. 1;

FIG. 3 is a partial sectional view, at an enlarged scale, taken along line 3—3 of FIG. 2;

FIG. 4 is a partial sectional view taken along line 4—4 of FIG. 3;

FIG. 5 is a partial sectional view taken along line 5—5 of FIG. 3;

DETAILED DESCRIPTION OF THE PREFERRED EMBODIMENT

Figure 6:
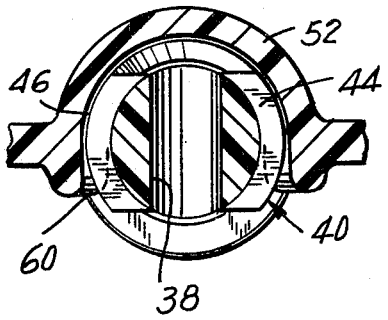
FIG. 6 is a partial sectional view taken along line 6—6 of FIG. 3.

Reference is now made to FIGS. 1 and 2 of the drawings, wherein a garment hanger construction generally indicated at 20 is depicted. Garment hanger construction 20 is formed of molded plastic and includes a hanger body 22 and a hook member 24 that is adapted to be releasably secured to hanger body 22 in a manner to be more fully discussed below.

Hook member 24 includes a hook portion 25 having a substantially T-shaped cross-section, shoulder 26, and an elongated shaft 36. Shoulder 26 includes a pair of circular side walls 28, best illustrated in FIG. 5, that form the segments of a circle, and a pair of flat end walls 30. Projecting from both end walls 30 are projections 32 having a side wall 34 and defining a first operative locking device, the projections extending out no further than the circumference of the circle formed by extending the circular side walls 28.

Elongated shaft 36 includes a throughhole 38 formed therein. A truncated conical projection 40 is divided into two projecting flanges by throughhole 38. The projecting flanges include an inclined surface 42, a flat shoulder surface 44 and an edge surface 46 and defining a first operative swivel device.

Hanger body 22 includes substantially semi-circular bearing loops 48, 50, 52 and 54 alternatively disposed on each side of the hanger body, to define a bearing sleeve 56 adapted to receive the shaft 36 of the hook member 24. Bearing loop 54 includes a transverse end wall 58 for limiting the insertion of shaft 36 into bearing sleeve 56. Bearing loop 52 includes a pair of substantially semi-annular grooves 60,62 having a configuration corresponding to the projection 40 on shaft 36. Bearing loop 48 includes a collar 64 for engaging shoulder 26 of hook member 24. Collar 64 is generally U-shaped and includes a pair of walls 66,67 directed inwardly toward said hook members to define a slot 69 for receiving projection 32 of shoulder 26 formed on hanger body 22. Accordingly, when projection 32 is disposed in slot 69, the hook member is prevented from rotating and slot 39 defines a second operative locking device. Bearing loop 48 also includes a semi-annular recess 68 having a diameter greater than that of shoulder 26 and projection 32 to allow rotation of hook member 24 with respect to hanger member 22 when shoulder 26 is axially displaced to a position where the projection 32 and shoulder 26 are disposed in the recess 68.

Figure 7:
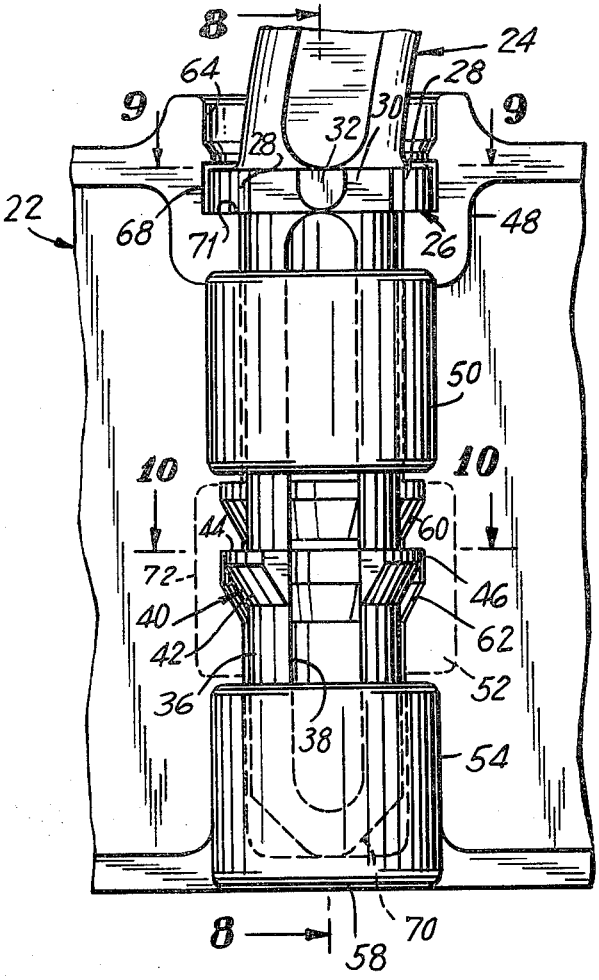
FIG. 7 is an elevational view, at an enlarged scale, of the central portion of the garment hanger construction with the hook member in its swivel position.
Figure 8:
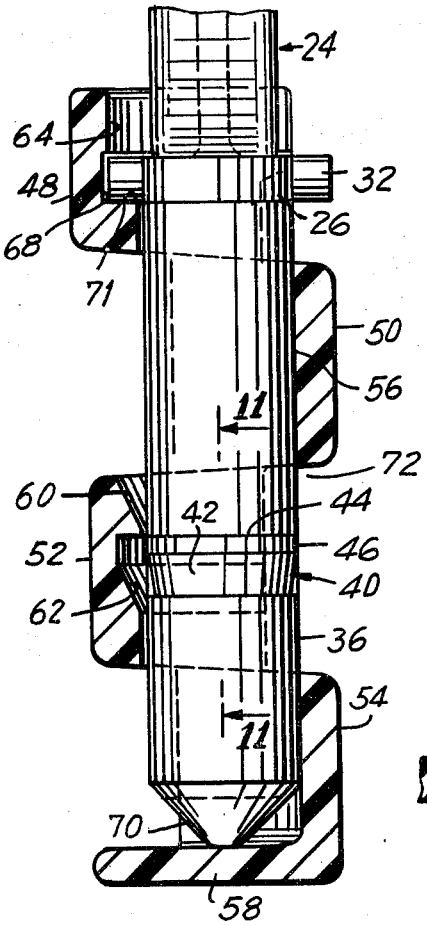
FIG. 8 is a partial sectional view taken along line 8—8 of FIG. 7.
Figure 9:
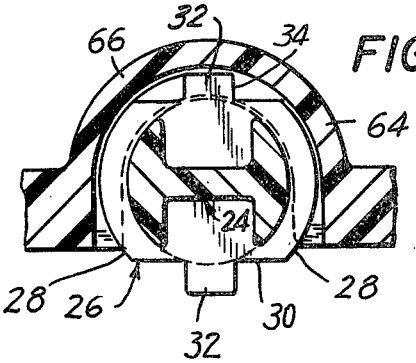
FIG. 9 is a partial sectional view taken along line 9—9 of FIG. 7.
Figure 10:
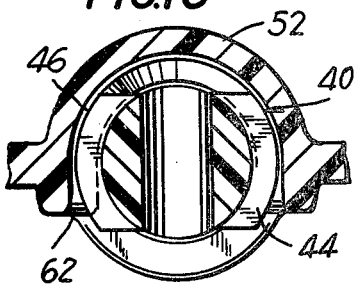
FIG. 10 is a partial sectional view taken along line 10—10 of FIG. 7.
Figure 11:
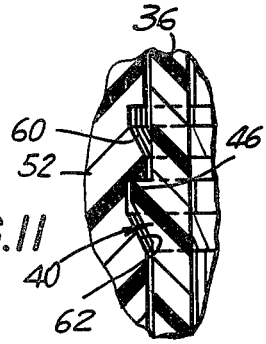
FIG. 11 is a partial sectional view taken along line 11—11 of FIG. 8.

Shaft 36 of hook member 24 is insertable into the bearing sleeve 56 defined by the bearing loops 48, 50, 52 and 54. The inclined surface 42 of the flanges in combination with the throughhole 38 causes the flanges to be collapsibly cammed inwardly until the flanges are brought into alignment with annular groove 60. Once flanges 40 are aligned with respect to groove 60, the flanges flex outwardly and nest in groove 60, preventing the hook member 24 from being released from hanger body 22. When flange 40 is engaged in groove 60, as is particularly illustrated in FIGS. 2 through 6, shoulder 26 is disposed at a predetermined distance from flanges 40 to insure that shoulder 32 will be disposed in slot 69 to thereby prevent hook member 24 from rotating with respect to hanger body 22. Should rotation of hook member 24, with respect to hanger body 22, be desired, hook member 24 may be further displaced into the bearing sleeve 56 in order to cause flanges 40 to be inwardly deflected, disengaged from groove 60, and engaged in groove 62, in the manner depicted in FIGS. 7 through 11. The predetermined distance between shoulder 26 and flanges 40 causes shoulder 26 to be axially aligned with recess 68 in bearing sleeve 48 when flanges 40 are engaged in groove 62 which groove defines a second operative swivel device to thereby permit rotation (swiveling) of hook member 23 with respect to hanger body 22. Any further downward displacement will be prevented by the abutment of tip 70 of shaft 36 against end wall 58, as well as by the abutment of collar 26 with the edge 71 of bearing loop 49.

By disposing bearing loops on the respective sides of hanger body 22, in alternating fashion, in combination with elongated shaft 36 of hook member 24, a rigid garment hanger construction is provided. Moreover, hook member 24 may be removed from hanger body 22 by applying an inwardly directed lateral force to shaft 36 proximate to the opening 72 located between bearing loops 50 and 54 to thereby inwardly flex the flanges so that the effective diameter of shaft 36 is reduced, whereupon hook member 24 can be removed from hanger body 22. It is noted that the engagement of projection 40 in grooves 60,62 in bearing loop 52 is sufficient to effect positioning and securing of hook member 24 to hanger body 22 without the need for end wall 58 and edge 71 of bearing loop 48.

It is seen that a garment hanger construction in accordance with the preferred embodiment of the instant invention provides a releasable hook member which, when disposed in a first position is prevented from swiveling with respect to the hanger member, and which when disposed in a second position is capable of swiveling through an angle of 360° with respect to the hanger member. Thus, for storage, shipment and the like, swiveling can be prevented whereas, an effective, yet rigid swivel hook hanger construction, is provided when the hook member is displaced to a swivel position.

Finally, although the locking arrangement described and illustrated is directed to a collar including a notch disposed in the hanger body, and a projection formed in the shaft, this relationship can be readily reversed so that the notch is formed in the hook shaft and the projection is disposed on the hanger body.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A garment hanger construction comprising a hook member, said hook member having an elongated shaft supporting a first operative locking means and a first operative swivel means, and a hanger body including receiving means for receiving said shaft, said receiving means including second operative locking means constructed and arranged to cooperatively define a first locked position with said first operative locking means disposed on said shaft and further including second operative swivel means for cooperatively defining a second swivel position with said first operative swivel means disposed on said shaft for permitting said hook member to freely rotate at said second swivel position and for preventing said hook member from being longitudinally displaced as it is freely rotated at said second swivel position, said shaft being coordinately displaceable in said receiving means along the lengthwise extent thereof between said first locked position and said second swivel position.

2. A garment hanger construction as claimed in claim 1, wherein said first operative locking means disposed on said shaft is a first lateral projection means, and said second operative locking means is a slot means for receiving said laterial projection means when said shaft is disposed in said first locked position to thereby prevent said shaft from swiveling with respect to said hanger body.

3. A garment hanger construction as claimed in claim 2, wherein said first operative swivel means on said shaft is a second lateral projection means, and said second operative swivel means is constructed and arranged to receive said second lateral projection means when said shaft is displaced to said second position to permit said hook to swivel with respect to said hanger body.

4. A garment hanger construction as claimed in claim 2, wherein said hook member is releasably secured to said hanger body.

5. A garment hanger construction as claimed in claim 2, wherein said means for receiving said shaft comprises a bearing sleeve.

6. A garment hanger construction as claimed in claim 3, wherein said swivel means includes a first recess corresponding to said first locked position and a second recess corresponding to said second swivel position, said second lateral projection means being engageable in said first and second recesses.

7. A garment hanger construction as claimed in claim 2, wherein said elongated shaft of said hook member includes flexible projections substantially intermediate the lengthwise extent of said shaft, said flexible projections being collapsibly flexed together in response to a laterally directed force applied thereto, said receiving means forming a bearing sleeve dimensioned to receive a shaft, said bearing sleeve including first and second recess means disposed intermediate the lengthwise extent of said bearing sleeve, said first and second recess means respectively corresponding to said locked and said swivel positions of said hook member.

8. A garment hanger construction as claimed in claim 7, wherein said elongated shaft includes a substantially circular cross-section, and an elongated throughhole at the position of said to said projections for rendering same collapsibly flexible together.

9. A garment hanger construction as claimed in claim 7, wherein said bearing sleeve includes at least one bearing loop defining said recess means formed therein for engaging said projections.

10. A grament hanger construction as claimed in claim 9, and including at least two bearing loops, each said bearing loop being substantially semi-circular and alternately disposed on opposite sides of said first operative locking means.

11. A garment hanger construction as claimed in claim 10, wherein at least one of said bearing loops includes said locking means, said locking means having a notch for receiving said first operative means.

12. A garment hanger construction as claimed in claim 11, wherein said first operative locking means comprises a first lateral projection on said elongated shaft.

* * * * *